United States Patent [19]

Sellers

[11] Patent Number: 4,466,669

[45] Date of Patent: Aug. 21, 1984

[54] METHOD OF OPEN CUT MINING

[76] Inventor: Gordon Sellers, 632 Princes Hwy., Woonona, New South Wales, 2517, Australia

[21] Appl. No.: 448,297

[22] Filed: Dec. 9, 1982

[30] Foreign Application Priority Data

Dec. 18, 1981 [AU] Australia ..... PF2023

[51] Int. Cl.[3] ..... E21C 41/00

[52] U.S. Cl. ..... 299/7; 299/18; 299/19

[58] Field of Search ..... 299/18, 19, 7, 10

[56] References Cited

U.S. PATENT DOCUMENTS

| | | | |
|---|---|---|---|
| 906,765 | 12/1908 | Anderson | 299/19 X |
| 3,349,848 | 10/1967 | Burgh | 166/259 |
| 3,975,053 | 8/1976 | Kochanowsky | 299/19 X |
| 4,103,972 | 8/1978 | Kochanowsky | 299/18 |
| 4,150,853 | 4/1979 | McCoy | 299/18 |

*Primary Examiner*—Stephen J. Novosad

*Attorney, Agent, or Firm*—Kane, Dalsimer, Kane, Sullivan and Kurucz

[57] ABSTRACT

In a method of open pit mining, a tunnel or tunnels are driven into one or more seams of minerals to be mined or in the surrounding rock, and draw shafts are formed between and connecting the earth's surface and tunnels. A bulk transport or conveyor system is installed in the tunnel or tunnels to remove material passed down the shafts to the surface. Overburden is removed such that the minerals are accessible on the surface adjacent the shafts. The minerals are then deposited into the shafts and transported by the bulk transport conveyor system to a storage area external of the pit. The overburden can also be deposited into the shafts for removal from the pit. The land to be mined is preferably divided into a substantial rectilinear grid pattern or formation, and a draw shaft is formed in each of the elemental areas of the grid pattern.

3 Claims, 5 Drawing Figures

METHOD OF OPEN CUT MINING

The present invention relates to an improved method of open cut mining.

With conventional open cut mining it is normal to use a loading type device such as a drag line to remove the overburden, and to remove the required minerals, or to use power shovels to load the minerals onto trucks which then leave the pit by means of ramps to deposit minerals such as coal in a holding area.

These types of operations result in several disadvantages, in that the equipment cost of the drag line and the skips or trucks are very expensive, the drag line is limited to the depth of operation without excess handling and increase in costs, and heavy duty access ramps have to be prepared when using skips or trucks.

The present invention ameliorates these problems. In one broad form the invention comprises a method of open cut mining comprising the steps of:

driving a tunnel or tunnels into one or more seams of minerals to be mined or in the surrounding rock; sinking or raising hole(s) or shaft(s) between the surface and the said tunnels or tunnel;

installing a bulk transport or conveyor system or systems in the tunnel or tunnels to remove material from the bottom of said holes or shafts to the surface; removing the overburden remote from said hole(s) such that the minerals are accessible on the surface adjacent to said hole(s); and depositing the minerals into the hole(s) such that they can be transported by the bulk transportor conveyor system to a storage area external of the pit.

In a further broad form the invention comprises a method of open cut mining comprising the steps of:

driving a tunnel or tunnels into one or more seams of minerals to be mined or in the surrounding rock; sinking or raising hole(s) or shaft(s) between the surface and the said tunnels or tunnel;

installing a bulk transport or conveyor system or systems in the tunnel or tunnels to remove material from the bottom of said holes or shafts to the surface; depositing the overburden into said hole(s) such that the minerals are accessible on the surface adjacent to said hole(s); and transporting the minerals to a storage area external of the pit.

The overburden can be deposited into the hole or holes for removal from the pit, or some of the overburden can be moved within the pit by dozer or other conventional means to an area of the pit remote from the area being worked.

The present invention provides among others the following advantages over existing methods:

1. Low Capital Cost.

The capital required per tonne is significantly less than that for other methods.

2. Low Manpower.

The number of men required is significantly less than that for other methods.

3. Reduction of Access Roadways.

Access into the pit can be limited to steep access roads where crawler or tracked type vehicles only need be used with the consequent minimization of major pit haul roads and ramps.

4. Pit Sidewall Slumping Minimized.

Low wall stability requirements are minimized as low walls are maintained further away from the working area than is practicable for other methods.

5. Depth of Mining Improved.

The depth of mining is not limited by either the method or the equipment used providing the overburden ratio is within the required limit of costs.

6. Ability to Work Multi-Seam Deposits.

The method will allow for the mining of multiple seams, or layers, whether thick or thin, without appreciable changes in operating costs.

7. Substantially Higher Mining Recovery.

Overall mining recovery from an area is increased due to less limitations on depth of mining and enhanced probability of thin layer recovery.

8. Minimization of Drilling and Blasting.

By the implementation of this invention, the need for drilling and blasting techniques as the primary breaking system is minimized, as ripping is the preferred breaking system, with consequential cost, manpower and production delays reduced.

9. Low Total Mining costs.

Relative to other mining techniques, overall mining cost are minimized by virtue of the following aspects:

high material recovery, low manpower requirement, low capital requirement, the maximum use of conveyors, or other bulk transport system, for material transportation.

In a preferred embodiment of the present invention the primary access and mine development to expose the target material and overburden and for the removal of the same is via a combination of:

access ramps, an array of draw shafts (holes), from surface to an underground draw level, over the entire area to be exploited, underground access tunnels interconnecting the lowest level of the draw shafts, main access tunnels from surface to the underground draw level.

Ripping is the preferred breaking technique of the overburden on target material, but other methods may be used if required.

Draw shafts are almost totally used to transfer material from the surface to the draw level, with conveyors or other bulk transport systems to transport the material from the underground draw level to the surface stockpile areas, in the case of recoverable materials, and to mine backfill and other areas in the case of non-recoverable materials.

The invention will now be described by way of example with reference to the accompanying drawings in which.

Figure 1:
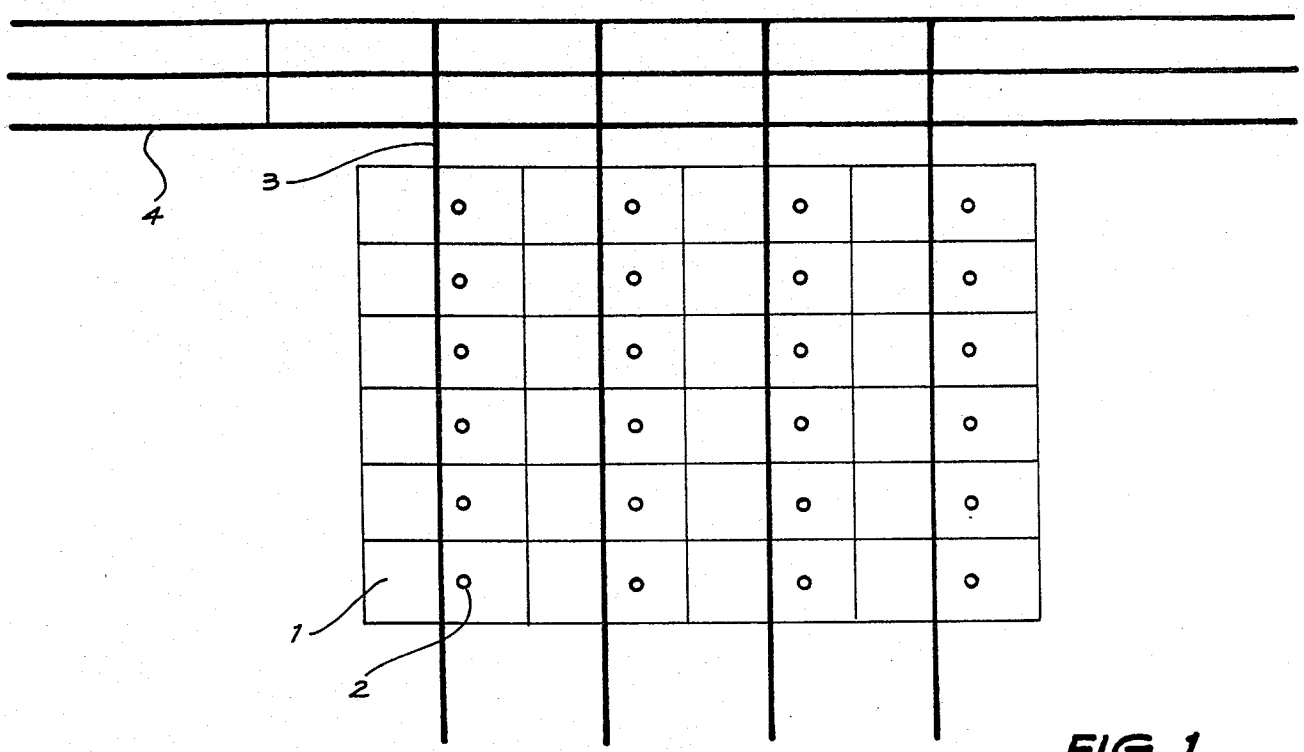
FIG. 1 illustrates a general array of underground access tunnels, draw shafts and elemental areas of an embodiment of the present invention.
Figure 3:
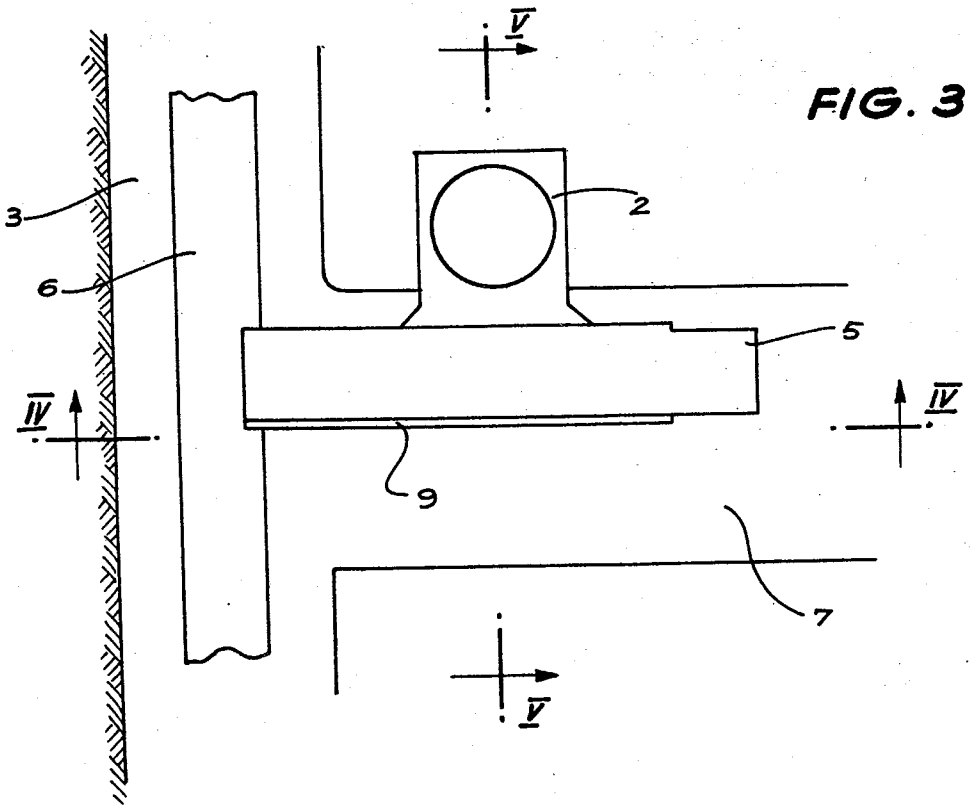
FIG. 3 is a schematic plan view of the arrangement at the bottom of a draw shaft according to one embodiment of the present invention.
Figure 4:
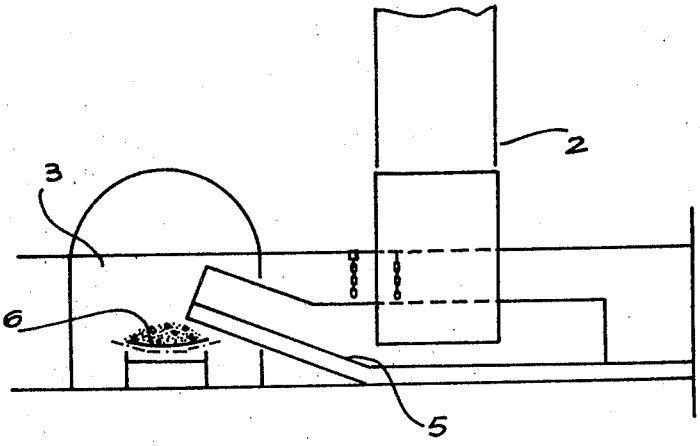
FIG. 4 is a sectional view taking along line IV—IV in FIG. 3.
Figure 5:
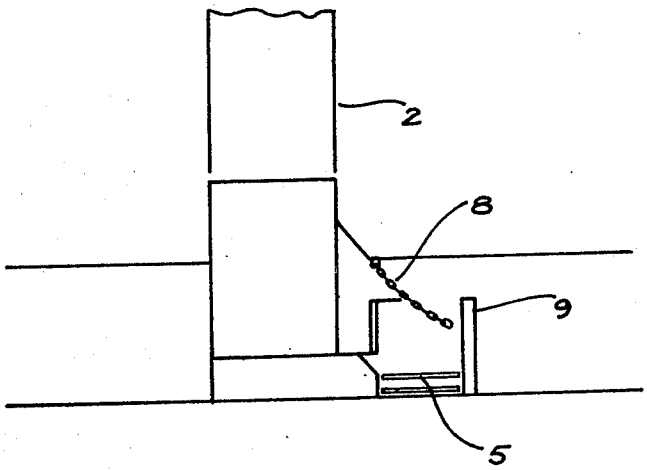
FIG. 5 is a plan view taken along line V—V in FIG. 3.

To implement the method of the present invention the area to be exploited is divided into a regular array of elemental areas (1) as shown in FIG. 1. Draw shafts 2 are located symmetrically within each incremental area between the surface and the underground draw levels. Underground draw level tunnels 3 connect the draw shaft of a strip of elemental areas, to the main underground access tunnels 4. Beneath each draw shaft 2 is, as shown in FIGS. 3, 4, and 5, a feeder 5, which transferes the material which arrives down the draw shaft to a bulk transport system in this case a belt conveyor 6 in the draw level tunnel 3. Any suitable feeder could be used provided it is robust enough to withstand the impact of the material fall down the draw shaft. Chain screens 8 and baffles 9 can be used where needed to prevent overflow of the feeder.

Figure 2:
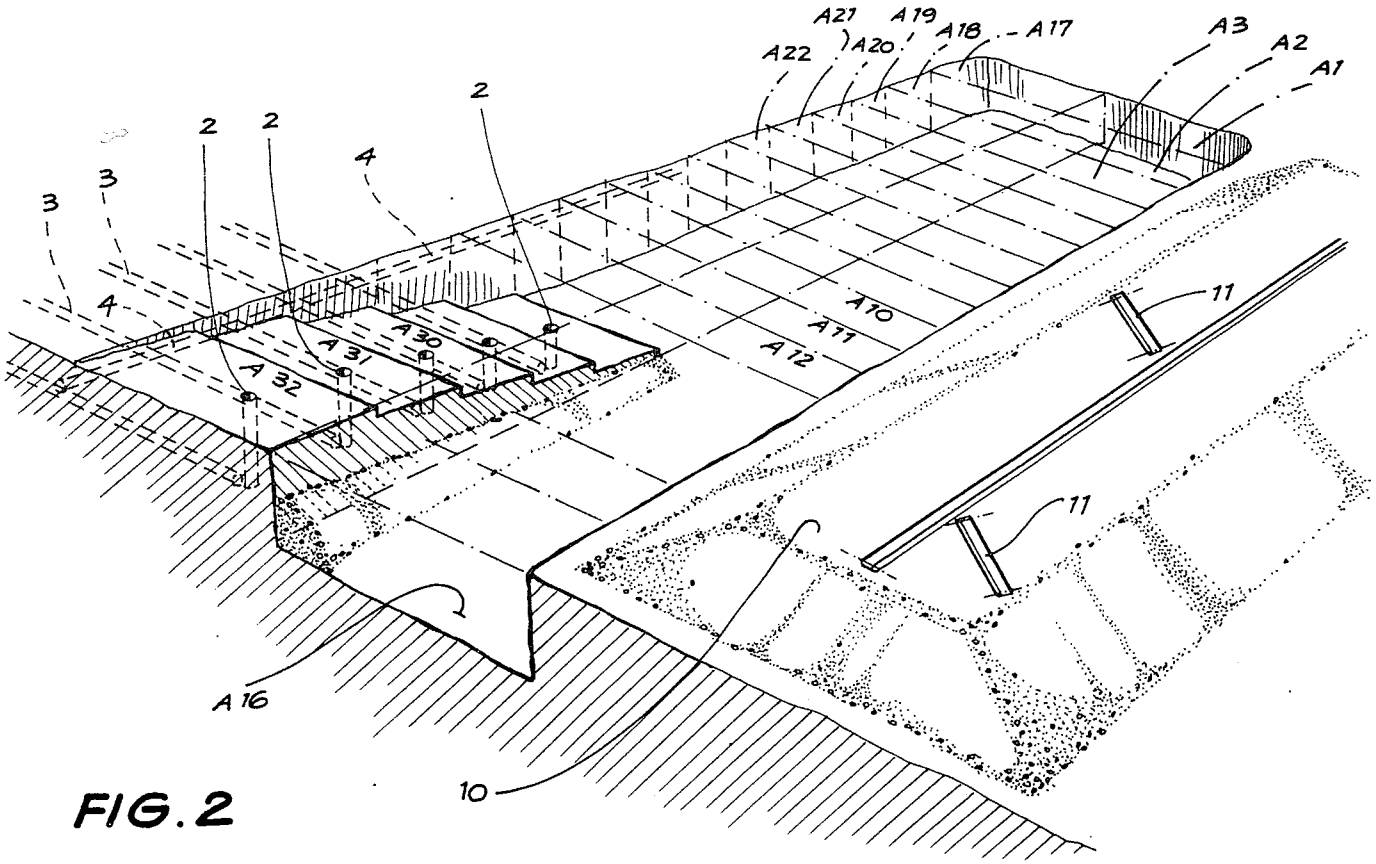
FIG. 2 illustrates a schematic representation of a layout of an embodiment of the present invention after production is established.

The mining process is arranged so that a strip of the area to be exploited is worked as a continuous unit. A strip is made up of a number of contiguous element areas, the number of which may vary from application to application. As each strip is worked out, so the adjacent strip is normally worked, as shown in FIG. 2 wherein the strip A1 to A16 have been worked and the strip A17 to A32 is in the process of being worked.

The mining process commences with the breaking of material to be removed, whether recoverable or non-recoverable. The ripped material is moved to the draw shafts 2. In some instances, non-recoverable materials may be moved to one side as opposed to being presented to the draw shaft and in others the recoverable materials may be removed directly from the pit without going down the draw shaft.

All material presented to the draw shaft then passes through the draw shaft onto feeders and thence onto the underground transportation system.

In a multilayered deposit, with successive layers of recoverable and non-recoverable material, the separate layers are extracted to a plan, determined by the particular application, but in such a manner as to avoid working of dissimilar materials simultaneously within elemental areas of the same strip.

At the surface, recoverable materials are transported to stockpiles for on-processing. Non-recoverable materials are transported to mine backfill or other waste disposal areas 10 see FIG. 2 where it is spread by a travelling spreader 11. Once a suitable size void has been created in the mine area by the complete removal of one or more strips, the non-recoverable materials may be dumped and spread in the void as a mine reclamation process.

The successive extraction of strips and backfilling of voids proceeds until the planned exploitation area has been worked out.

It should be noted that the methods of the present invention provide a cheap and easy method of working open cut mines which are presently using existing methods unworkable because of the high costs involved. The present invention is applicable to the mining of minerals such as coal.

It should be obvious to people skilled in the art that modifications can be made to the embodiments described above without departing from the spirit or the scope of the present invention.

The claims defining the invention are as follows:

1. A method of open cut mining comprising the steps of dividing an area of land to be mined into a substantially rectilinear grid formation, sinking or raising a shaft in each of the elemental areas of said grid formation, driving at least one tunnel into one or more seams of the minerals to be mined or in the surrounding rock, said tunnels linking said shafts;

installing a bulk transport system in said tunnels to remove material passed down said shafts to the surface;

mining said elemental areas in a terraced formation relative to adjacent areas being worked such that access from areas being worked to adjacent elemental areas are by means of access ramps, said overburden being deposited in said shafts and removed from the mining area by the transport system and the minerals being deposited into the shafts to be transported by said bulk transport system to a storage area external of the area of land to be mined.

2. A method of open cut mining according to claim 1 wherein said elemental areas are worked in terrace formation along a row of said grid formation, such that as each row is worked out the adjacent row is being worked.

3. A method according to claim 1 or 2 wherein once a sufficient number of elemental areas have been worked out the overburden and non recoverable materials is dumped in the worked out elemental areas.

* * * * *